US005775199A

United States Patent [19]

Sell

[11] Patent Number: 5,775,199

[45] Date of Patent: Jul. 7, 1998

[54] ROTARY VALVE AND DIRECTIONAL VALVE COMBINATION

[75] Inventor: Leslie J. Sell, Bothell, Wash.

[73] Assignee: Ingersoll-Rand Company, Woodcliff Lake, N.J.

[21] Appl. No.: 590,235

[22] Filed: Jan. 23, 1996

[51] Int. Cl.[6] ..... F01B 3/10

[52] U.S. Cl. ..... 91/498; 91/503; 91/448; 137/270; 137/270.5; 137/624.13

[58] Field of Search ..... 91/498, 503, 444, 91/448; 137/270, 270.5, 624.13

[56] References Cited

U.S. PATENT DOCUMENTS 666,690 1/1901 Pickles ..... 91/503

2,397,594 4/1946 Buchanan ..... 91/503

FOREIGN PATENT DOCUMENTS 56983 5/1981 Japan ..... 91/503

295182 10/1992 Japan ..... 91/503

*Primary Examiner*—F. Daniel Lopez

*Attorney, Agent, or Firm*—Walter C. Vliet; Leon Nigohosian, Jr.

[57] ABSTRACT

The combination of a cylindrical rotary distribution valve which is supplied pressure fluid alternately at either end to sequentially supply and exhaust pressure fluid such as compressed air radially to a selectively reversible hoist motor and a directional spool valve disposed in parallel valve body bores and interconnected with the rotary distribution by short direction passageways provide a compact one body valve electing efficient air distribution and exhaust.

4 Claims, 2 Drawing Sheets

ROTARY VALVE AND DIRECTIONAL VALVE COMBINATION

BACKGROUND OF THE INVENTION

This invention relates to air motor valves and more particularly to a combination rotary supply and directional control valve for hoist motors and the like. In the conventional arrangement on current piston air motors, the rotary valve is mounted at the back of the motor and is driven by pins that engage the crank shaft. This requires exact alignment, a separate rotary valve housing and a separate directional control valve and housing.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by a rotary distribution valve and directional spool valve combination for use with an air motor operated hoist or the like comprising a rotary valve disposed in a valve first body bore and driven in rotation by an air motor receiving a distributed supply of air from the rotary valve in sequential order to operate the motor; a spool valve disposed in a valve second body bore for reciprocation from a forward position supplying air to the rotary valve to effect forward rotation of the motor and to a rearward position supplying air to the rotary valve to effect reverse rotation of the motor; and the first body bore and the second body bore are interconnected by a first passageway and a second passageway alternately supplying and exhausting air from the spool valve to a first face end of the rotary valve and to a second face end of the rotary valve to effect distribution and exhaust of air to and from the motor.

This invention is a rotary valve arrangement for supplying and exhausting compressed air to and from the pistons of an air motor. In this novel arrangement, the long restricted air passages that are common in current rotary valves are replaced by a more direct air supply and exhaust path which improves the efficiency of energy transfer to and from the pistons. A second improvement in efficiency is gained by incorporating the directional control valve directly into the air supply and exhaust system of the rotary valve. A third improvement in efficiency is gained by utilizing a well known method of exhausting the primary air from the pistons at the bottom of their stroke through holes in the cylinder walls, instead of through a hole in the rotary valve. Reduced cost and complexity is achieved by mounting the rotary valve directly on the crankshaft at the front of the motor with the directional control valve housed in the motor body adjacent to it. The foregoing and other aspects of the invention will become apparent from the following detailed description of the invention when considered in conjunction with the accompanying drawing figures.

BRIEF DESCRIPTION OF THE DRAWING FIGURES

DETAILED DESCRIPTION

Figure 1:
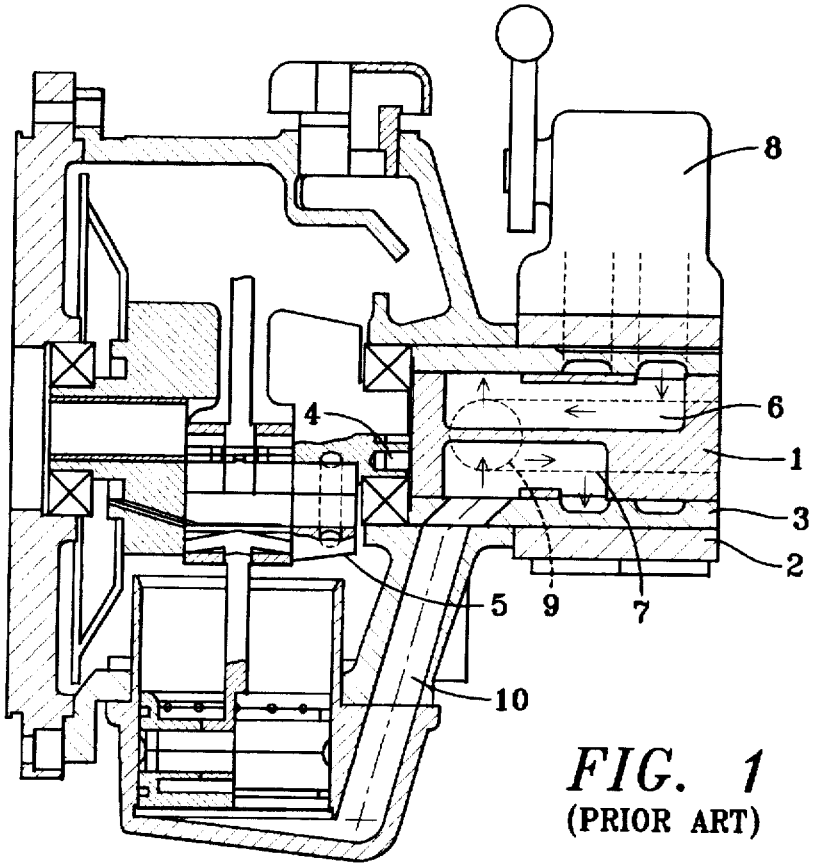
FIG. 1 (PRIOR ART)
FIG. 1 is an elevation cross sectional view of a typical piston air motor according to the prior art.

Referring to FIG. 1 the conventional arrangement is as follows:

A typical piston air motor is shown in cross section with the rotary valve 1 housed in separate housing 2 at the rear. The rotary valve runs in bronze sleeve 3 and is driven by pins 4 which are accurately aligned and engaged in crank 5. Air passages 6 and 7 communicate with cylinder ports 10 and with directional control valve 8 mounted on rotary valve housing 2. Depending on which direction that the air motor is running, if air passage 6 is supplying air to drive a piston from the top of its stroke to the bottom, air passage 7 will, at the same time, be venting air from an opposing piston as it goes from the bottom of its stroke to the top. This venting cycle is called the secondary exhaust cycle. A primary exhaust cycle is usually carried out on piston air motors in which the compressed air that is in the cylinder at the instant that the piston reaches the bottom of its stroke, is vented directly through the rotary valve and out through exhaust passage 9 at the back of the motor, bypassing the directional control valve completely. This air passage is indicated by dotted lines 9. The primary exhaust cycle improves the operating efficiency of the air motor by reducing the volume of air that must be pushed by the pistons back through the directional control valve. The arrows on passages 6 and 7 indicate that the supply and exhaust air must reverse direction completely when passing through the rotary valve.

Figure 2:
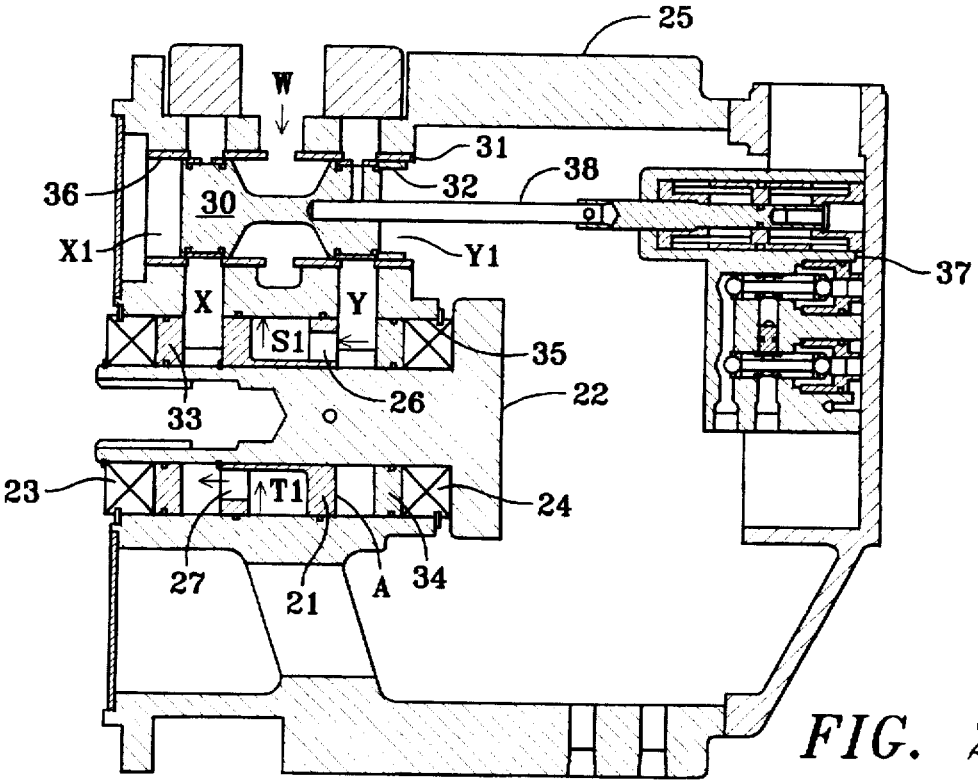
FIG. 2 is a cross sectional view of a 4 cylinder radial piston air motor taken between the cylinders according to the present invention.
Figure 3:
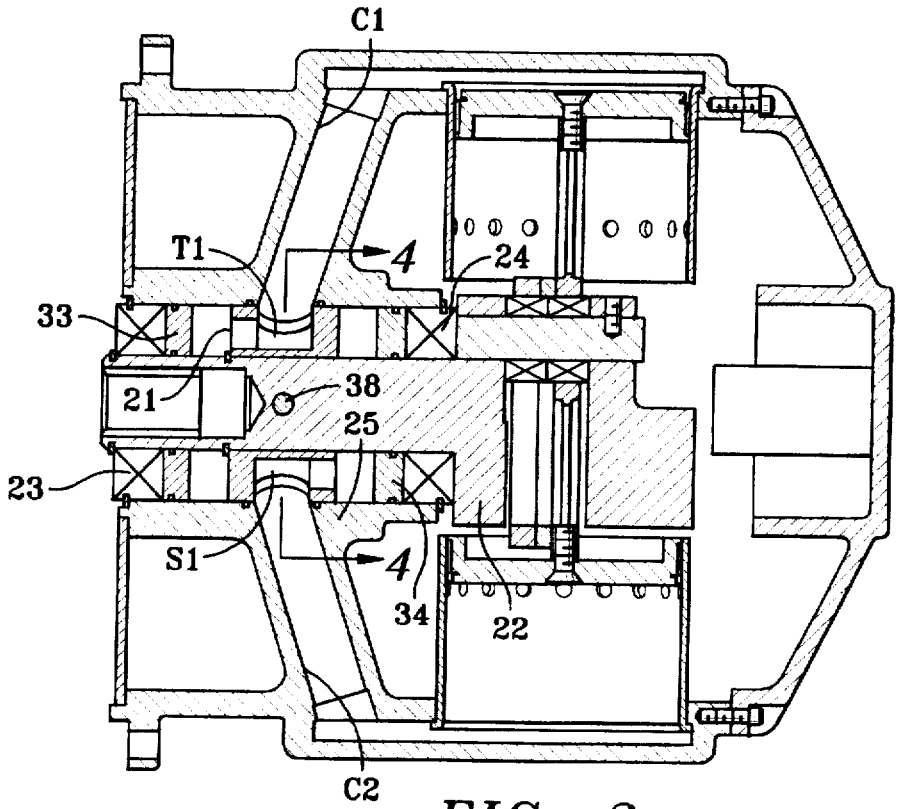
FIG. 3 is a cross sectional view of a 4 cylinder radial piston air motor taken through the cylinders according to the present invention.

Referring to FIGS. 2 and 3, the novel arrangement is as follows:

A novel design piston air motor is shown in cross section with a simplified rotary valve 21 mounted on the crankshaft 22. The crankshaft is carried on bearings 23 and 24 pressed into the motor body 25. Bearings 23 and 24 have the same outside diameter as rotary valve 21 allowing it to have a close running fit in the housing bore 35. FIG. 3 shows cylinder ports C1 and C2 aligning and communicating with cavities S1 and T1 in rotary valve 21. FIGS. 4 through 7 show a rotary valve 21 in detail where annular cavities S1 and T1 are separated by diametral lands M and L. Axial annular slot 26 passes through face A and connects with cavity S1 and axial annular slot 27 passes through face B and connects with cavity T1. Cavities S1 and T1 also have similar radial slots 28 (best seen in FIG. 6) and 29 (best seen in FIG. 4) allowing communication with cylinder ports C1 in sequence as the rotary valve rotates in motor housing 5.

Figure 4:
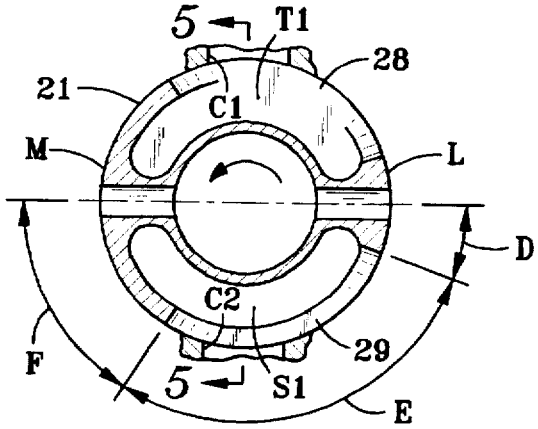
FIG. 4 is an end section view of the rotary valve according to the present invention taken at Section 4—4 of FIG. 3.
Figure 5:
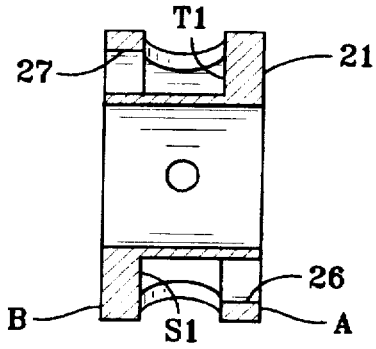
FIG. 5 is a cross section of the rotary valve taken at Section 5—5 of FIG. 4.
Figure 6:
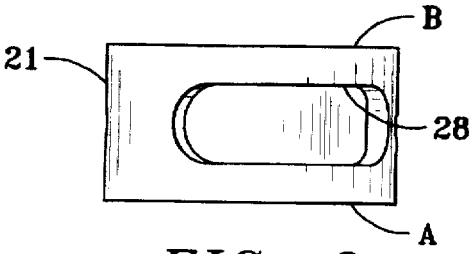
FIG. 6 is a plan of the rotary valve according to the present invention.
Figure 7:
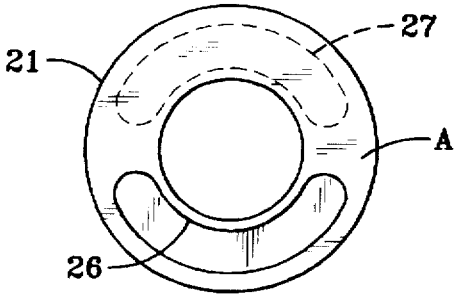
FIG. 7 is a front elevation of the rotary valve according to the present invention.

As shown in FIG. 4, the radial slots 28 and 29 effect the timing of air distribution and exhaust from cylinder ports C1 and C2 or any opposed pair of cylinder ports (C3, C4, etc.—not shown). For example, radial slot 29 may be provided with an angle of advance D1 and angle of supply E, and an angle of shut off F as determined relative to motor port C1 and top dead center of the motor piston (not shown) corresponding to C1 (assuming counterclockwise rotation)

and different but corresponding angles for radial slot 28 (exhaust timing). This permits air supply and exhaust timing to be selected for optimum motor performance. One feature of the present invention resides in the fact that the advantages of motor timing may be achieved for either selected primary direction of rotation by simply reversing the rotary valve 21 on crankshaft 22 when timing pin 38 is removed. As shown in FIG. 3, the timing pin 38 is located on the mid-point between face A and B to retain proper axial orientation on crankshaft 22.

FIG. 2 shows a cross section through the motor body that includes a section through the directional control valve in which spool 30 is carried in bore 36 in sleeve 31 which is pressed into the motor body. When directional control spool 30 is moved to the right by pneumatic actuator 37 through control rod 38, inlet supply air at port 'W' is directed to port 'Y' which supplies pressurized air to the right hand face A and cavity S1 through slot 26 of rotary valve 21 which, as it rotates, communicates this pressurized air to each cylinder in sequence. With spool 26 to the right, cavity T1, connected to port 'X' via slot 27, is vented to exhaust through channel 'X1' in the motor body. When spool 6 moves to the left, pressurized air is directed to port 'X' and cavity T1 while exhaust air is vented through port 'Y' to the motor body at 'Y1'. This reverses the direction of the motor. In the reverse direction, spool 30 is provided with a skirt extension 32 having a small radial clearance to provide a throttled flow of air.

Stationary seal rings 33 and 34 are provided with a tight fit in housing bore 35 and a relatively loose but sealing fit on crankshaft 22. This permits the seal rings to remain stationary in normal operation. The internal rotary seals that seal against crankshaft 22, prevent leakage of pressurized air from ports 'X' and 'Y'. A significant improvement in air flow between ports 'X' and 'Y' and cavities S1 and T1 is achieved by placing the entry and exit slots 26 and 27 on faces A and B respectively of the rotary valve. This allows a more direct air passage requiring only a single 90 degree turn to communicate with cylinder ports C1 and C2, as indicated by the arrows on FIG. 2.

Having described my invention in terms of a preferred embodiment, I do not wish to be limited in the scope of my invention except as claimed.

What is claimed is:

1. A rotary distribution valve and directional spool valve in combination with a selectively reversible air motor for use with an air motor operated hoist or the like comprising:

a selectively reversible air motor;

a valve body for receiving a supply of compressed air and selectively distributing said compressed air to said selectively reversible air motor;

a rotary valve disposed in a valve first body bore in said valve body and driven in rotation by said selectively reversible air motor receiving a circumferentially distributed supply of air from said rotary valve in sequential order to operate said air motor;

a spool valve disposed in a valve second body bore for reciprocation from a forward position supplying air to said rotary valve to effect forward rotation of said air motor and to a rearward position supplying air to said rotary valve to effect reverse rotation of said air motor;

said first body bore and said second body bore are interconnected by a first passageway and a second passageway alternately supplying and exhausting air from said spool valve to a first rotary valve end air chamber and a second rotary valve end air chamber and therefrom respectively to a first face end of said rotary valve exposed to said first rotary valve end air chamber and to a second face end of said rotary valve exposed to said second rotary valve end air chamber to effect distribution and exhaust of air to and from said motor;

said rotary valve is further provided with opposed circumferential distribution ports which sequentially registers in rotation with distribution ports for said air motor to effect supply and exhaust of air to and from said air motor;

said rotary valve is provided with end face entry and radial exit of supply air and conversely radial entry and opposite end face exit of exhaust air;

said rotary valve is provided with radial exit slots having different timing in registering with said distribution ports for said air motor to effect a different supply and exhaust timing for said air motor; and said rotary valve is mounted on an air motor driven shaft and reversible on said shaft at assembly to accommodate the difference in valve timing for selected primary clockwise or counterclockwise rotation of said air motor.

2. A rotary distribution valve and directional spool valve according to claim 1, wherein:

said rotary valve and said spool valve are disposed in parallel valve body bores.

3. A rotary distribution valve and directional spool valve according to claim 1, wherein:

said rotary valve is mounted on a rotating shaft of said air motor and is sealed within said bore by a spaced apart seal at each of said first and second face ends of said rotary valve to form an air supply chamber at one end of said rotary valve and an exhaust air chamber at an opposite end of said rotary valve;

each of said air supply chamber and said exhaust chamber are alternatively in communication via said first passageway and said second passageway to a pressurized supply of air or exhaust as determined by the reciprocated position of said spool valve.

4. A rotary distribution valve and directional spool valve according to claim 3, wherein:

said seal at each end is formed by a disc having a shaft bore and being pressed into said rotary valve bore and being;

said disc being further provided with a tight fitting external seal ring in contact with said valve first body bore and a relatively loose fitting internal seal ring in contact with said rotary shaft of said air motor.

* * * * *